US011331561B1

(12) United States Patent
Wu et al.

(10) Patent No.: US 11,331,561 B1
(45) Date of Patent: May 17, 2022

(54) MULTI-FUNCTION GROUND ENGAGING DEVICE

(71) Applicants: Kuang-Ming Wu, McLean, VA (US); Thomas Jason Wu, McLean, VA (US)

(72) Inventors: Kuang-Ming Wu, McLean, VA (US); Thomas Jason Wu, McLean, VA (US)

( * ) Notice: Subject to any disclaimer, the term of this patent is extended or adjusted under 35 U.S.C. 154(b) by 74 days.

(21) Appl. No.: 16/732,256

(22) Filed: Dec. 31, 2019

(51) Int. Cl.

| | |
|---|---|
| ***A63C 17/04*** | (2006.01) |
| ***A63C 17/00*** | (2006.01) |
| ***A43B 5/16*** | (2006.01) |
| ***A63C 17/06*** | (2006.01) |
| ***A63C 17/22*** | (2006.01) |
| ***A63C 17/14*** | (2006.01) |

(52) U.S. Cl.
CPC ..... *A63C 17/008* (2013.01); *A43B 5/1633* (2013.01); *A63C 17/06* (2013.01); *A63C 17/1436* (2013.01); *A63C 17/226* (2013.01); *A63C 2017/1481* (2013.01)

(58) Field of Classification Search
CPC ... A63C 17/008; A63C 17/004; A63C 17/226; A63C 17/1436
See application file for complete search history.

(56) References Cited

U.S. PATENT DOCUMENTS

| | | | | |
|---|---|---|---|---|
| 5,398,970 | A * | 3/1995 | Tucky | A43B 5/1633 280/11.19 |
| 5,882,087 | A * | 3/1999 | Post | A63C 17/06 301/5.306 |
| 5,887,898 | A * | 3/1999 | Petrosino | A43B 5/1641 280/825 |
| 6,454,279 | B1 * | 9/2002 | Yang | A43B 5/1633 280/11.223 |
| 8,480,095 | B2 | 7/2013 | Adams | |
| 8,727,359 | B2 | 5/2014 | Green | |
| 8,777,236 | B2 | 7/2014 | Bellehumeur et al. | |
| 8,915,502 | B2 | 12/2014 | Pennerath | |
| 8,998,217 | B1 | 4/2015 | Spano et al. | |
| 9,630,084 | B2 | 4/2017 | Yurkin | |
| 2002/0121749 | A1 * | 9/2002 | Lee | A63C 17/20 280/11.25 |
| 2003/0127811 | A1 * | 7/2003 | Adams | A63C 17/26 280/11.19 |
| 2004/0178588 | A1 * | 9/2004 | Yoo | A63C 17/008 280/11.221 |
| 2004/0239056 | A1 * | 12/2004 | Cho | A63C 17/008 280/7.1 |
| 2004/0251644 | A1 * | 12/2004 | Wang | A63C 17/20 280/11.24 |
| 2005/0001390 | A1 * | 1/2005 | Hurst | A63C 17/20 280/7.1 |
| 2006/0027409 | A1 * | 2/2006 | Adams | A63C 17/12 180/181 |
| 2008/0136126 | A1 * | 6/2008 | Yang | A63C 17/06 280/11.27 |
| 2008/0256831 | A1 * | 10/2008 | Maiores | A43B 5/1633 36/115 |

* cited by examiner

*Primary Examiner* — Brian L Swenson

(57) ABSTRACT

A ground-engaging devices that is capable of sustained rolling, stable braking, secure standing, and walking. In one preferred embodiment, the invention relates to a wheeled footwear device. In another preferred embodiment, the invention relates to a wheeled footwear platform. In yet another preferred embodiment, the invention relates to a wheeled artificial foot.

19 Claims, 17 Drawing Sheets

MULTI-FUNCTION GROUND ENGAGING DEVICE

BACKGROUND OF THE INVENTION

1. Field of the Invention

The invention relates to the field of ground-engaging devices for human and robots. More particularly, the invention relates to wheeled devices that enable sustained rolling with smooth transitions to stable braking, secure standing, and walking.

The invention comprises a wheeled footwear device, a wheeled footwear platform, and a wheeled artificial foot. Because their enabling methods for sustained rolling, stable braking, and secure standing are identical, the following discussion will primarily use "wheeled footwear device" as the representative design for clarity and simplicity.

2. Description of the Prior Arts

Footwear with wheel(s) for rolling have been invented by numerous inventors in the past decades, with many of them proposing some braking mechanism, or allowing the user to walk. However, the devices known to the art appear to suffer from shortcomings which make them impractical, undesirable, or both.

Skates with braking mechanisms largely share the same characteristic of applying friction to the wheels, which locks the rotating motion and keeps the skates from rolling. U.S. Pat. No. 8,777,236 to Bellehumeur lowers a conical braking element in between the rear two wheels to provide frictional contact and stop the rotation of both wheels. U.S. Pat. No. 8,727,359 to Green applies a brake pad to the rear wheel to halt motion. Approaches like these suffer from shortcomings including premature wheel abrasion, inefficient braking, and overall performance degradation.

Skates that allow walking generally vary in design and disadvantages. U.S. Pat. No. 8,998,217 to Spano houses wheels inside the sole of the shoe in an unsecure fashion, which may lead to the movement of the wheels and axles during rolling. U.S. Pat. No. 8,915,502 to Pennerath and U.S. Pat. No. 9,630,084 to Yurkin both store the skate wheels in a horizontal position in the bottom of the sole when walking. When users choose to roll, the wheels flip into a vertical position. These devices suffer from the inability to smoothly transition between rolling and walking. Also, the usage of complicated mechanisms adds significant weight and reduces the structural integrity of the skates.

Footwear with wheels which allow for transitions between rolling and walking have been invented, the most successful and noteworthy being U.S. Pat. No. 8,480,095 to Adams, the "heeling" device. However, "heeling" does not provide a sustainable rolling in view of the following aspects:

- It requires a running action to build up speed before transitioning to "heeling" with the user's weight on the heels, which is treacherous and dangerous, even for users with practice.
- Because "heeling" is virtually a "gliding" action with the user's weight on heels, it cannot generate much acceleration. Consequently its speed after transitioning is generally diminishing and unsustainable, and the distance it can glide after each transition is generally limited.

In view of the above differences, there exists a need for a device capable of providing sustainable rolling with smooth and safe transitions to stable braking, secure standing, and walking.

SUMMARY OF THE INVENTION

It is an object of the present invention to provide a ground-engaging device which enables sustained rolling, stable braking, secure standing, and walking. A further object of the present invention is to provide a ground-engaging device which allows smooth and safe transitions between sustained rolling, stable braking, secure standing, and walking. An additional object of the present invention is to provide a ground-engaging device for rolling, wherein the wheels can be easily removed and stowed for ordinary walking.

These objects and other features will be apparent to one having ordinary skill in the art from reading the descriptions and claims below.

BRIEF DESCRIPTION OF THE DRAWINGS

To ease understanding of the present invention and its advantages, figures of the brief description are organized into the following six groups:

1.
FIGS. 1 through 14 illustrate the exemplary embodiments and the enabling methods pertaining to a wheeled footwear device.
2.
FIGS. 15 through 19 illustrate the exemplary embodiments pertaining to a wheeled footwear device with wheels configured inside the sole.
3.

FIG. 1 illustrates exemplary embodiment I of the present invention related to a wheeled footwear device for multiple functions including sustained rolling.

FIG. 3 elaborates on the first function of exemplary embodiment I for sustained rolling.

FIG. 4 illustrates the second function of exemplary embodiment I for stable braking, secure standing, and brief period of stepping. (Stepping refers to walking with the user's weight on the heel-portion and arch-portion of the sole, which is particularly useful for going up and down stairs.) Also indicated is a stopper element configured at the lower aft portion of the heel to increase the friction with the ground surface for braking, standing, and stepping.

FIGS. 5 and 6 illustrate exemplary embodiment II of the invention for increased stability in braking and secure standing, wherein the heel-portion sole is configured with an extension element for supporting a fraction of the weight from the other device worn by the user.

FIG. 7 illustrates the stowage locations for the wheels, in addition to the rolling axle locations. (Note that, hereinafter, all rolling axle locations are indicated with clear circles, while all stowage locations are indicated with shaded circles.)

FIG. 8 illustrates exemplary embodiment III of the invention for long-distance walking, wherein all wheels are removed from rolling axle locations and stowed in different locations so as to avoid contacting the ground.

FIG. 9 illustrates another function of exemplary embodiment III for short-distance walking without removing all the wheels.

FIG. 10 illustrates one of the conventional methods using nuts and threaded rods for configuring wheels to various locations of the device.

FIG. 12 illustrates exemplary embodiment IV of the invention, wherein latching mechanisms are configured to prevent the wheels from inadvertent rolling during standing or walking.

FIG. 13 illustrates exemplary embodiment V of the invention, wherein a part of the sole and/or heel is removed for reducing the footwear weight.

FIG. 14 illustrates exemplary embodiment VI of the invention, wherein the device is configured in such a manner that its exterior shows a sole and heel with thickness similar to that of regular footwear.

FIG. 15 illustrates the first function of exemplary embodiment VII for sustained rolling with wheels configured inside the sole.

FIG. 16 illustrates the second function of exemplary embodiment VII for braking and secure standing.

FIG. 17 illustrates exemplary embodiment VIII that comprises two rolling axle locations as well as multiple stowage locations for the wheels.

FIG. 19 illustrates a method of securing wheel(s) by using two capped rods that are attracted to a magnet that is configured at the uncapped end of a rod. The obvious advantage of using the magnet is to have easy removability.

FIG. 20 illustrates exemplary embodiment IX of the invention pertaining to a wheeled footwear platform with two straps for fastening regular footwear, which is configured with a plurality of axle locations and stowage locations for wheels.

FIG. 21 illustrates the first function of exemplary embodiment IX for sustained rolling.

FIG. 22 illustrates the second function of exemplary embodiment IX for braking and secure standing.

FIG. 23 illustrates exemplary embodiment X for short-distance walking without removing all the wheels.

FIG. 24 illustrates exemplary embodiment XI of the invention, pertaining to an adjustable wheeled footwear platform used in combination with regular footwear that may comprise soles of different thickness and slope.

FIG. 25 illustrates the first function of exemplary embodiment XII pertaining to a wheeled footwear platform with wheels configured inside the sole.

FIG. 26 illustrates the second function of exemplary embodiment XII for braking and secure standing.

FIG. 27 illustrates exemplary embodiment XIII that comprises two rolling axle locations as well as multiple stowage locations for the wheels.

FIGS. 28 and 29 illustrate exemplary embodiment XIV of the invention in the form of a wheeled artificial foot that can be attached to, but not limited to, a controlling prosthetic or robotic limb.

FIG. 30 illustrates exemplary embodiment XV of the invention pertaining to a footwear device configured conventionally with forefoot-portion and heel-portion wheels, wherein wheels can be removed from the rolling axle locations and stowed selectively onto locations in the sole and on the counter.

DETAILED DESCRIPTION OF THE PREFERRED EMBODIMENTS

Figure 25:
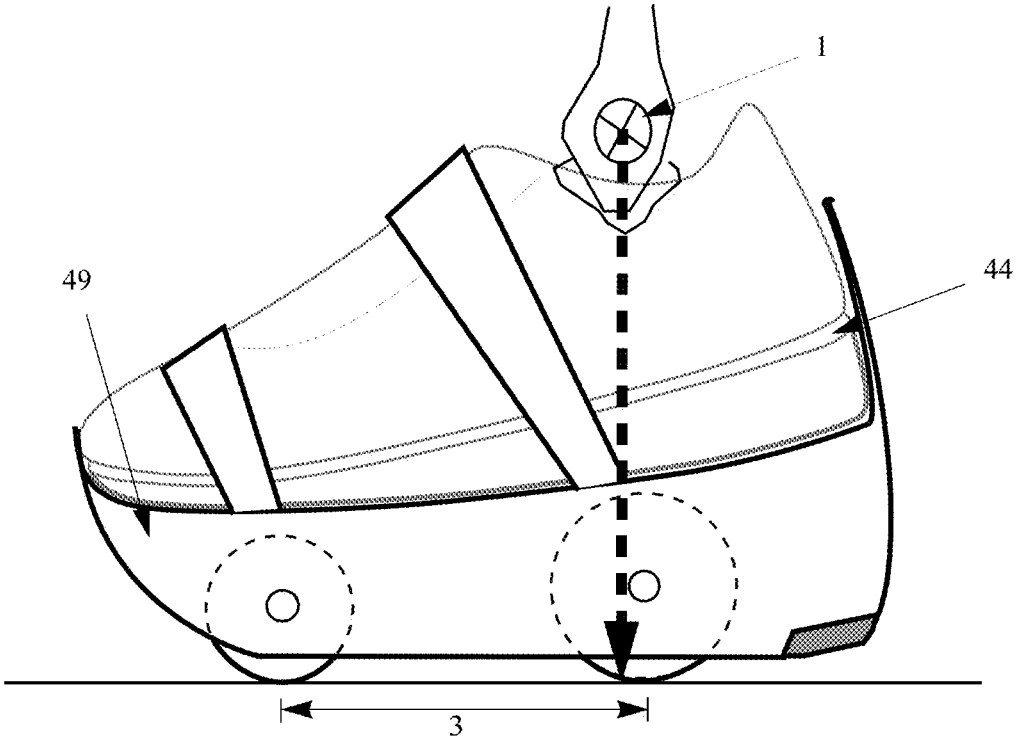
FIGS. 25 through 27 illustrate the exemplary embodiments pertaining to a wheeled footwear platform with wheels configured inside the sole of the platform.
5.
Figure 26:
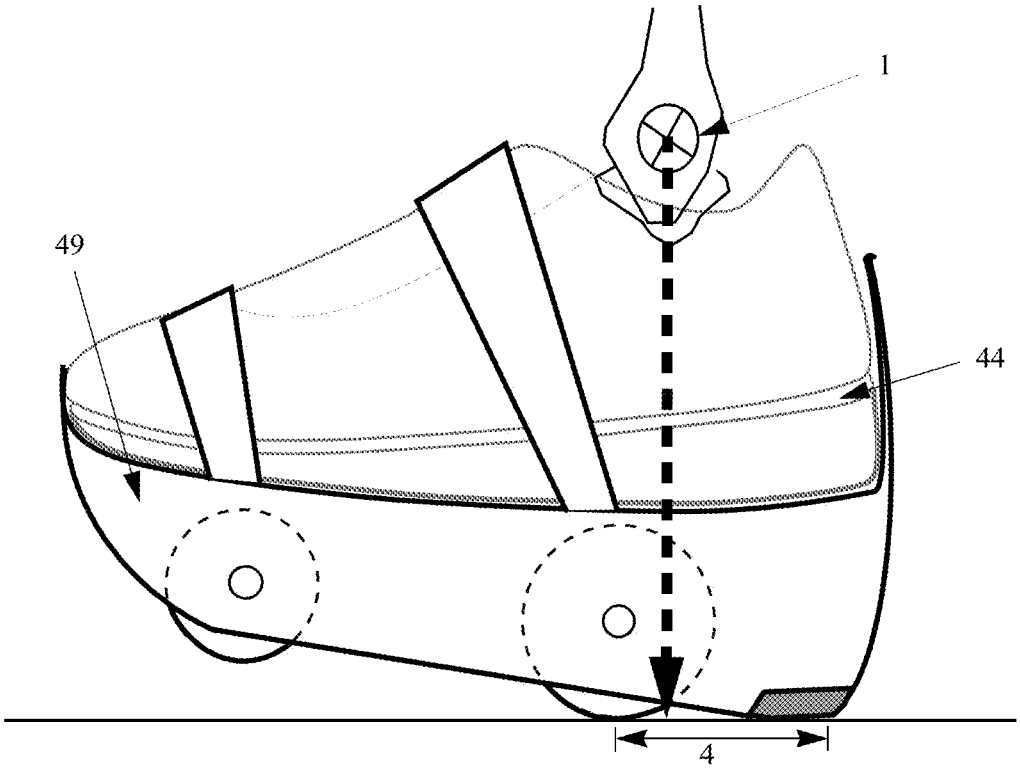
Figure 27:
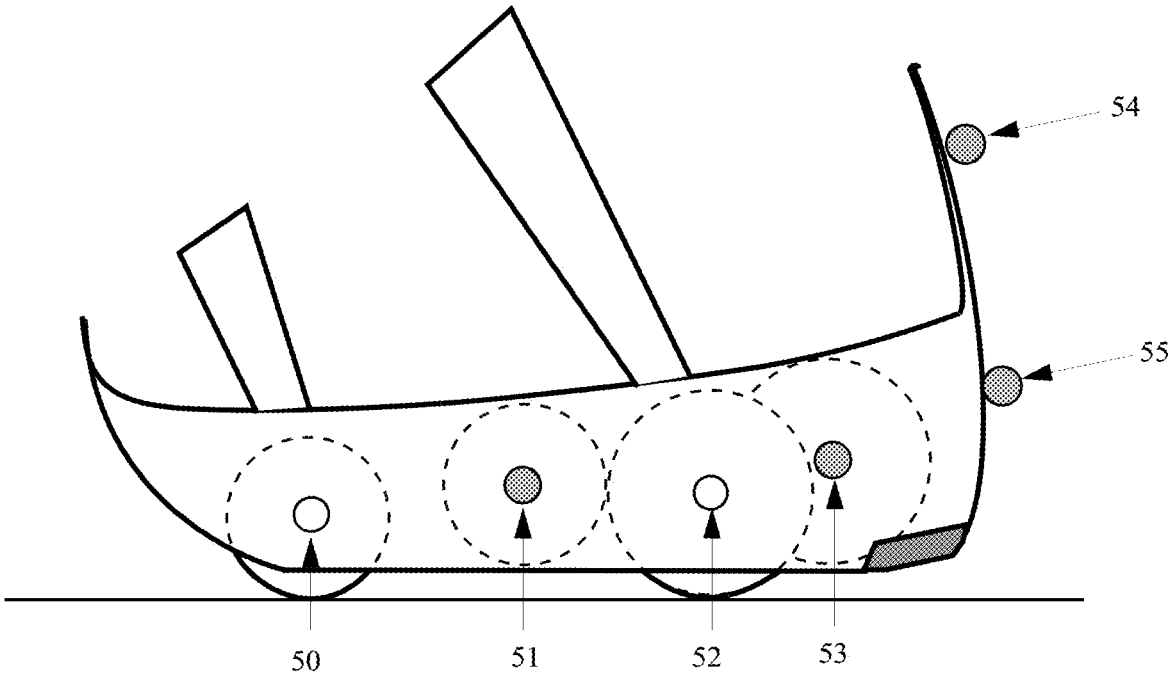
Figure 28:
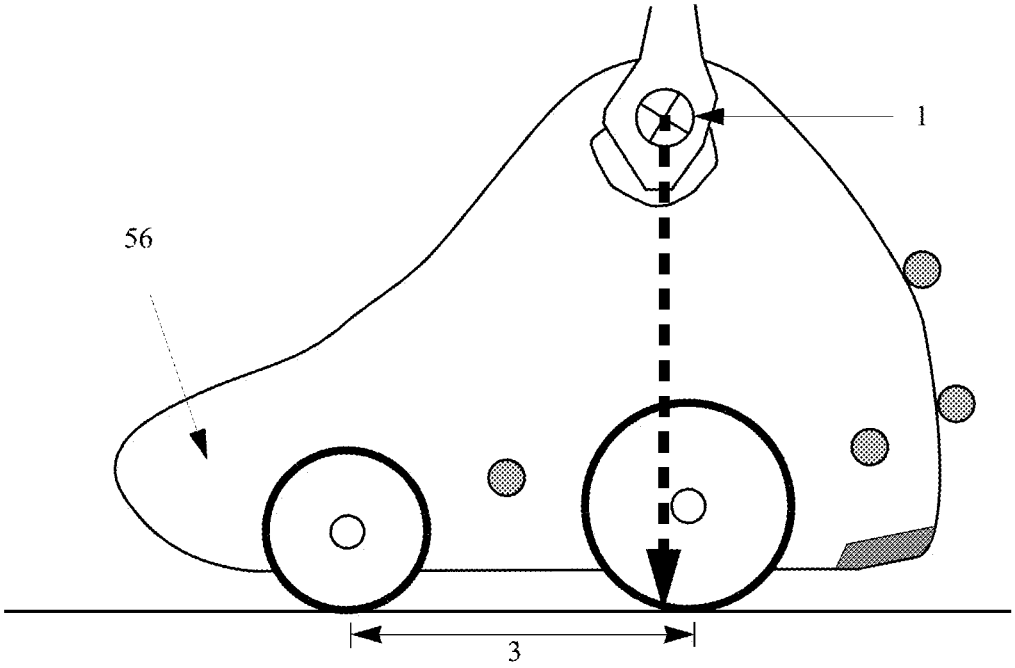
FIGS. 28 through 29 illustrate the exemplary embodiments pertaining to a wheeled artificial foot.
6.
Figure 29:
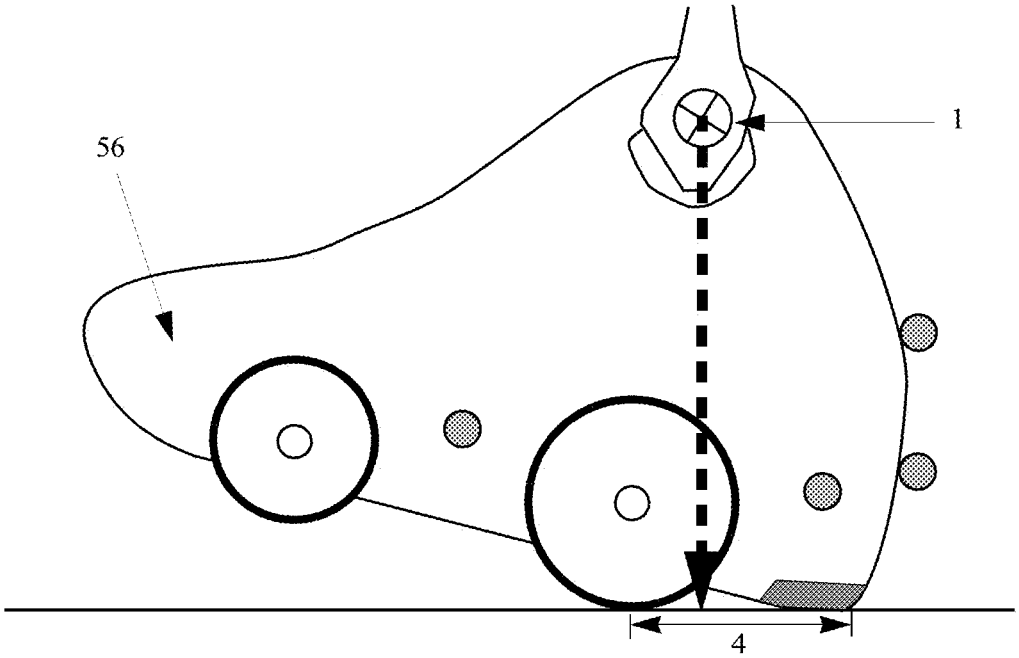
Figure 30:
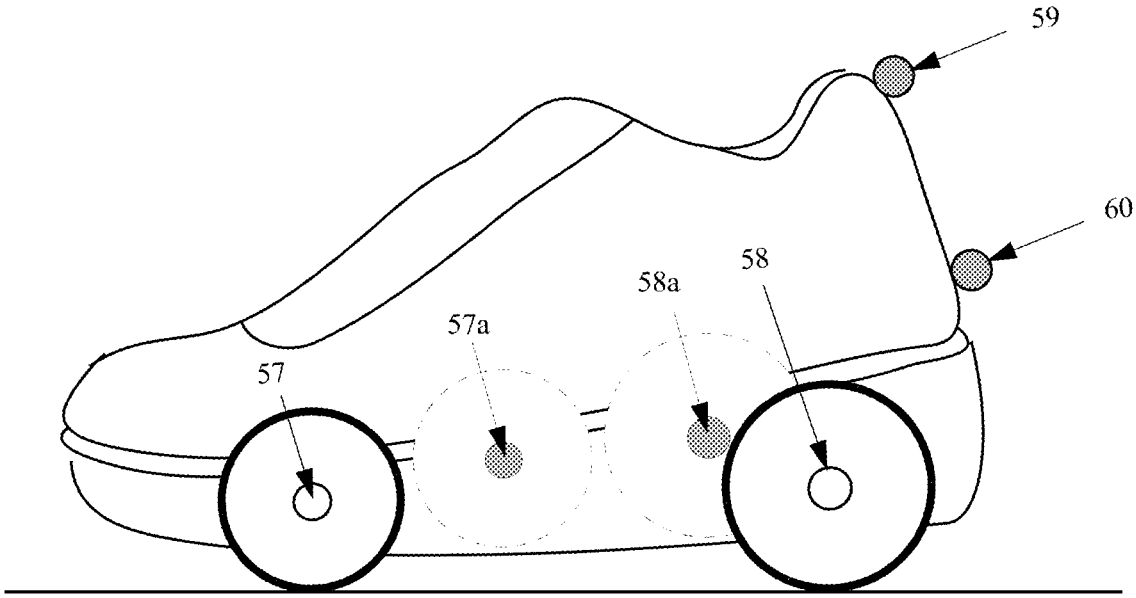
FIG. 30 illustrates an exemplary embodiment pertaining to wheel-stowage locations for a conventional wheeled footwear device that has wheels configured in the fore-foot-portion and heel-portion of the sole.

FIGS. 1 through 30 illustrate various preferred embodiments of the present invention. As mentioned, the figures are organized into the following six groups:

1. FIGS. 1 through 14 illustrate the exemplary embodiments and the enabling methods pertaining to a wheeled footwear device.
2. FIGS. 15 through 19 illustrate the exemplary embodiments pertaining to a wheeled footwear device with wheels configured inside the sole.
3. FIGS. 20 through 24 illustrate the exemplary embodiments pertaining to a wheeled footwear platform.
4. FIGS. 25 through 27 illustrate the exemplary embodiments pertaining to a wheeled footwear platform with wheels configured inside the sole of the platform.
5. FIGS. 28 through 29 illustrate the exemplary embodiments pertaining to a wheeled artificial foot.
6. FIG. 30 illustrates an exemplary embodiment pertaining to wheel-stowage locations for a conventional wheeled footwear device that has wheels configured in the forefoot-portion and heel-portion of the sole.

It should be understood that, in the following descriptions, the forefoot portion, the arch portion, and the heel portion of the sole vary from one footwear type to another. Thus, the location, the boundaries between, and the size of various portions of the sole are approximations.

Figure 1:
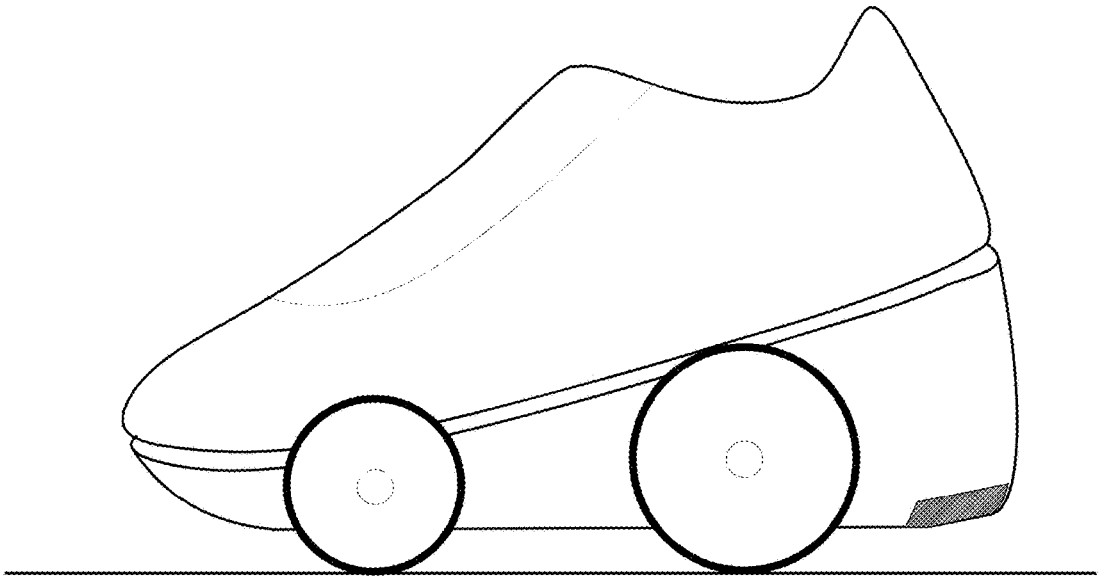

FIG. 1 illustrates exemplary embodiment I of the present invention related to a wheeled footwear device that is configured with wheels in the forefoot-portion and arch-portion of the sole for multiple functions including sustained rolling on the surface. This embodiment is distinguished from conventional roller skates that require wheel(s) to be configured in the heel portion of the sole for rolling.

Figure 2A:
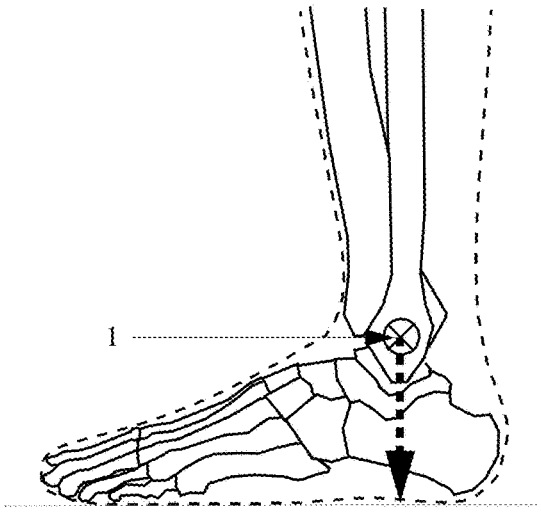
FIGS. 2A and 2B depict the enabling methods of the present invention, using a skeletal foot as an explanatory aid.
Figure 2B:
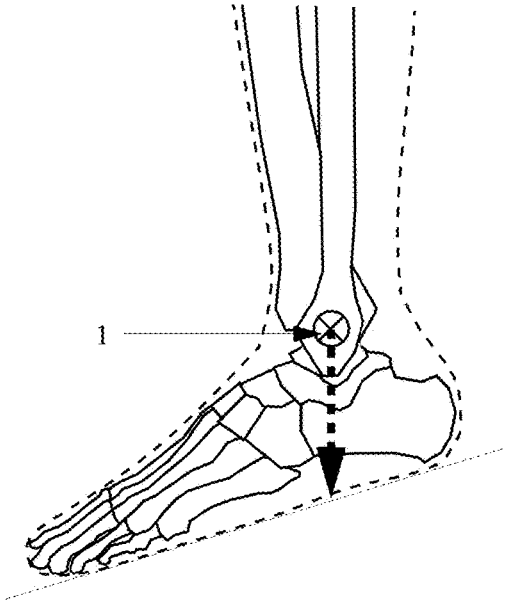

FIGS. 2A and 2B depict the enabling methods of the present invention, using a skeletal foot as an explanatory aid. Dashed lines are used to depict the profiles of the leg and foot. As it is known, the body weight transmits through the ankle and distributes onto the foot. A bold dashed arrow 1 is used to indicate the resultant vector of this transmitted load, which is referred to as the ankle load hereinafter. The ankle load points vertically downward due to the earth's gravity, but its projection point may move forward and aft along the sole, depending on the slope of the supporting surface, which is the key method enabling the present invention.

FIG. 2A shows that in an up-right standing posture with a person's foot nearly level, the ankle load 1 normally projects vertically downward near the heel. However, if a person's forefoot is tilted down as shown in FIG. 2B, the ankle load 1 will project toward the arch portion of the foot. We identified this phenomenon and successfully invented a footwear device for sustained rolling without wheels configured in the heel portion of the sole, which is unique in comparison with all prior arts. Detailed descriptions of various exemplary embodiments is in the following.

Figure 3:
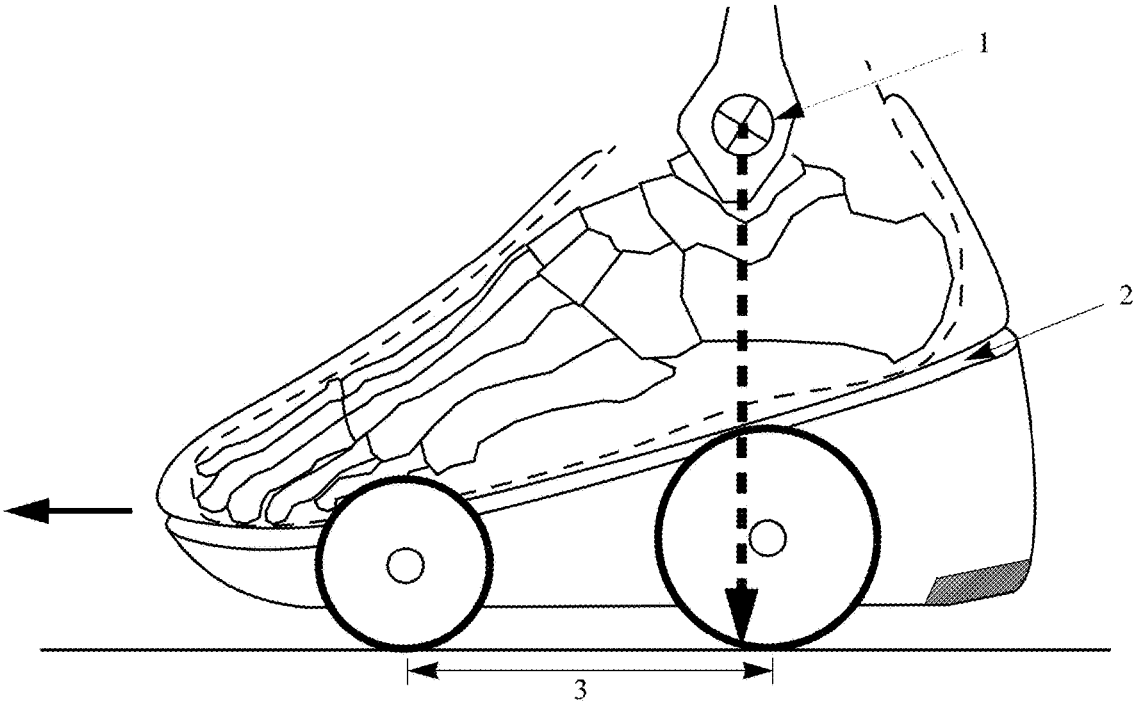

FIG. 3 elaborates on the first function of exemplary embodiment I for sustained rolling. As illustrated, the geometry and configuration of the device enable the top side of the footwear sole 2 to function as a sloped supporting surface that allows the user's forefoot to tilt down and project the ankle load 1 onto the front span 3 between the forefoot-portion wheels and the arch-portion wheels, which enables a balanced and sustained rolling. Hereinafter, it should be understood that the footwear sole refers to the combination of the outsole, the insole, and any internal cushion/materials used for supporting the user's foot to an inclination for desired projections of ankle load.

Figure 4:
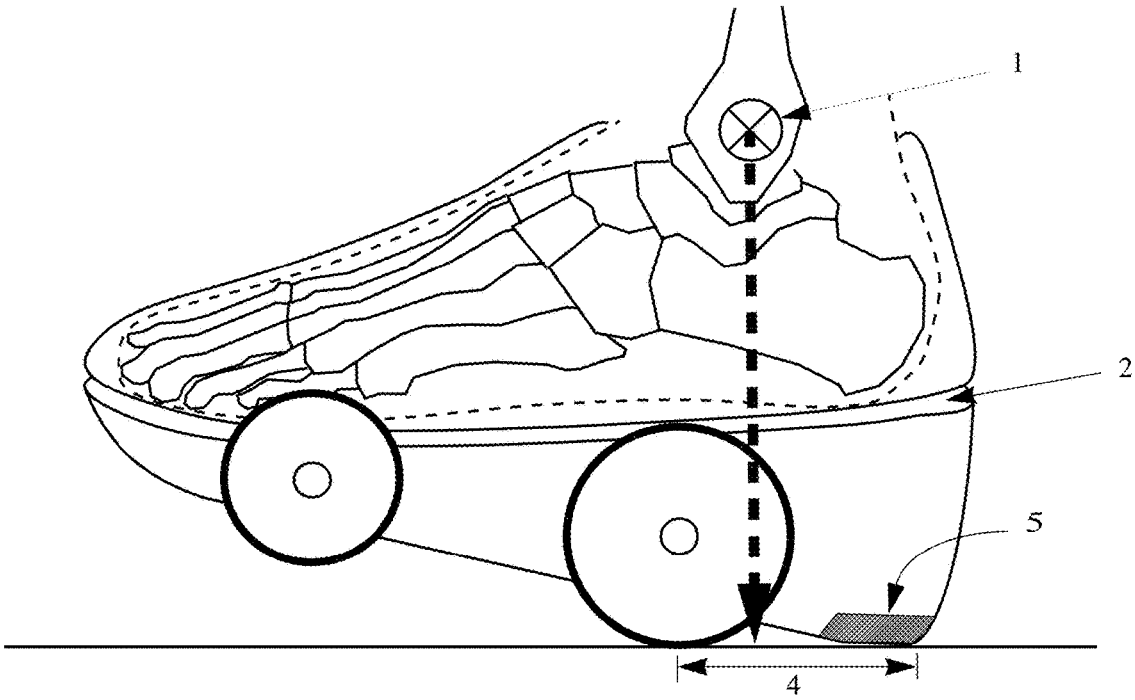

FIG. 4 illustrates the second function of exemplary embodiment I for stable braking and secure standing. As the user shifts the weight aft, the footwear device rotates about the arch-portion wheels. Consequently, the top side of the footwear sole 2 becomes more level and allows the user to project the ankle load 1 onto the rear span 4 between the arch-portion wheels and the lower aft portion of the heel (referred to as heel-tip hereinafter), which enables braking, standing, as well as stepping. Stepping refers to walking while keeping the ankle load 1 projecting onto the rear span 4, which is particularly useful for going up and down stairs.

It is important to note that both functions of exemplary embodiment I as indicated in FIGS. 3 and 4 can only be enabled by the footwear design and the strategic location of the arch-portion wheels that satisfy the following two conditions:

1. In order to enable a balanced and sustained rolling, the arch-portion wheels need to be configured sufficiently aft of the forefoot-portion wheels, so as to form a sufficiently long front span 3 for supporting the ankle load and encompassing its projection point that may vary during rolling. In addition, flexibility of the sole should be properly designed lest the middle part of front span 3 inadvertently contacts the ground surface while rolling.
2. In order to enable braking and secure standing, the arch-portion wheels need to be configured sufficiently forward of the heel-tip, so as to form a sufficiently long rear span 4 for supporting the ankle load and encompassing its projection point during braking and standing. In contrast to the comment made in the previous condition, flexibility of the sole is a lesser concern for braking and standing. In some operations, by using the foot to apply force and/or bending moment, the user may be able to deform the sole to an extent that the forefoot-portion wheels also contact the ground at the same time as the heel-tip.

FIG. 4 also indicates that a stopper element 5 made of materials including, but not limited to, rubber and polymers can be configured at the heel-tip to increase the friction with the ground surface for braking and secure standing.

Figure 5:
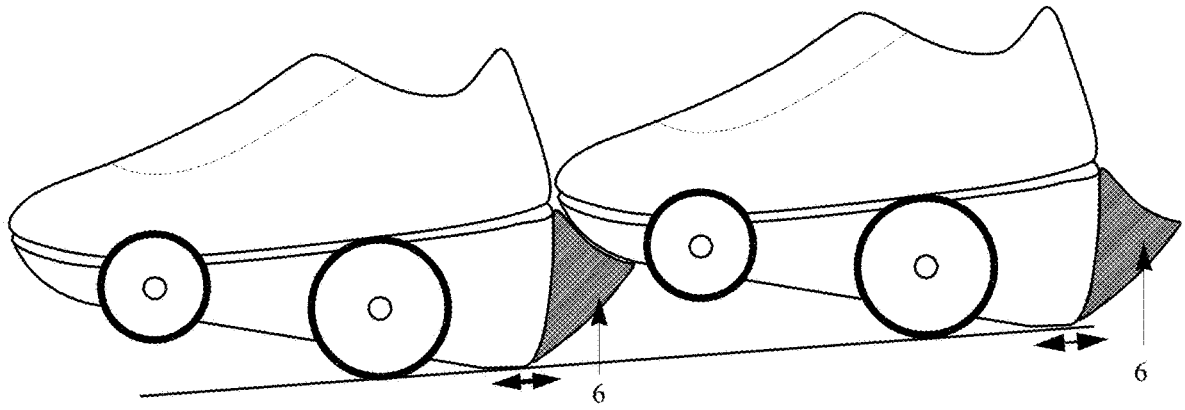

FIG. 5 illustrates exemplary embodiment II of the invention for increased stability in braking and secure standing, wherein the heel-portion sole is configured with an extension element 6 (extended aft and/or sideways) for supporting a fraction of the weight from the other device worn by the user. This is particularly useful for braking and secure standing on sloped terrains. As indicated, by placing the toe portion of a footwear device on the extension element 6 of a leading footwear device, the user can increase the stability of both devices for braking and secure standing on a sloped surface.

Figure 6:
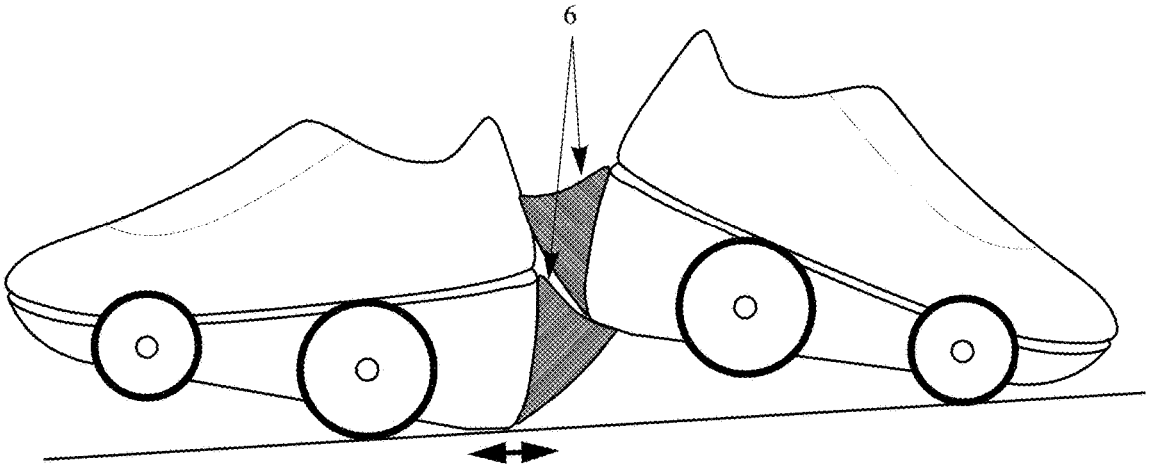

FIG. 6 illustrates another method of exemplary embodiment II, which increases the stability for secure standing on terrains.

Figure 7:
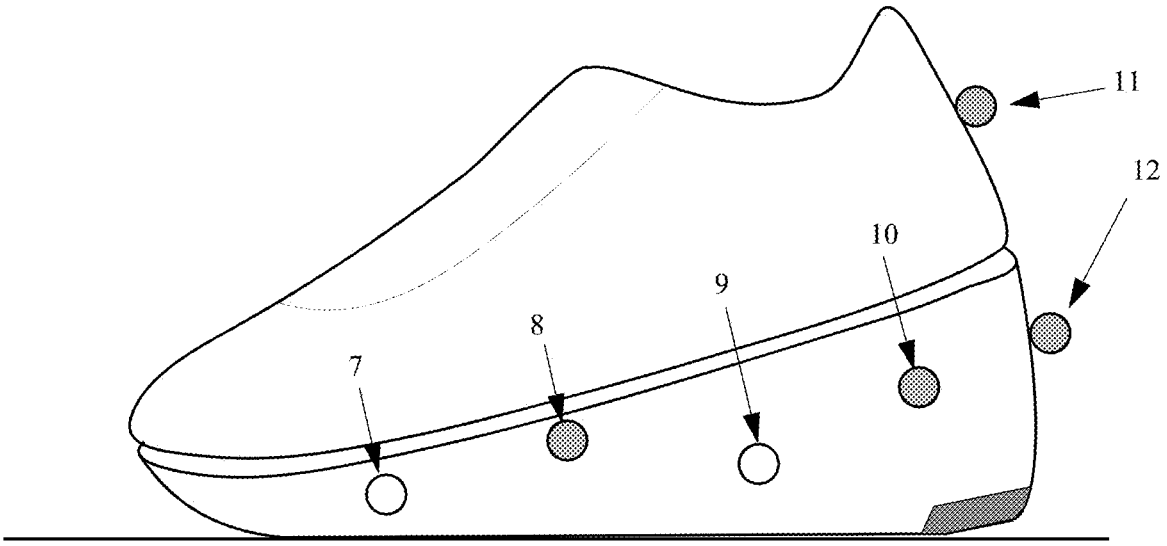

FIG. 7 illustrates the stowage locations 8, 10, 11 and 12 for the wheels, in addition to the rolling axle locations 7 and 9. (Note that, hereinafter, all rolling axle locations are indicated with clear circles, while all stowage locations are indicated with shaded circles.)

Figure 8:
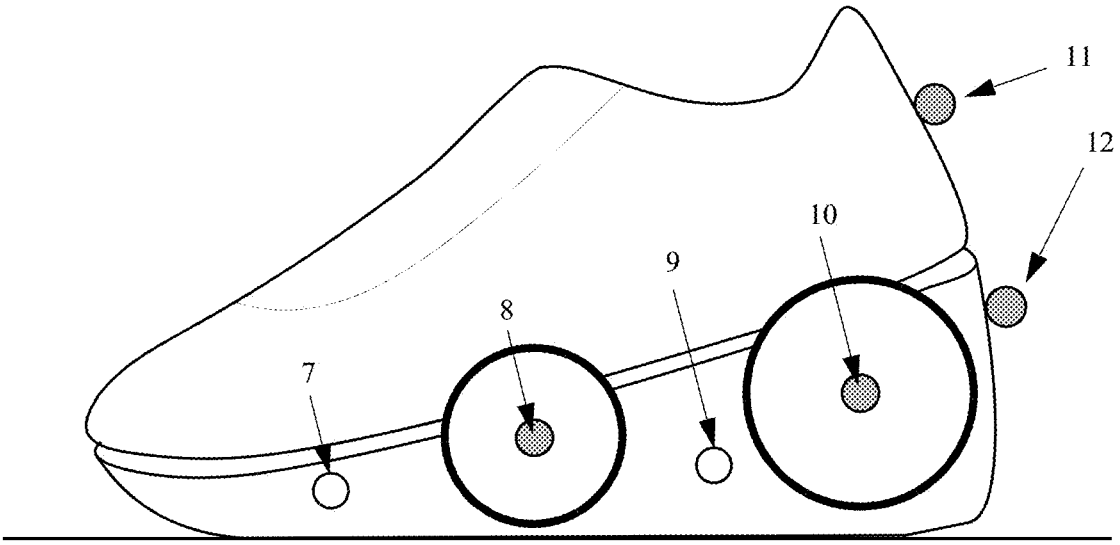

FIG. 8 illustrates the first function of exemplary embodiment III for long-distance walking, wherein all wheels are removed from rolling axle locations 7 and 9 and stowed in different locations such as 8, 10, 11 and 12 of the footwear so as to avoid contacting the ground. The device can thus function like regular shoes.

Figure 9:
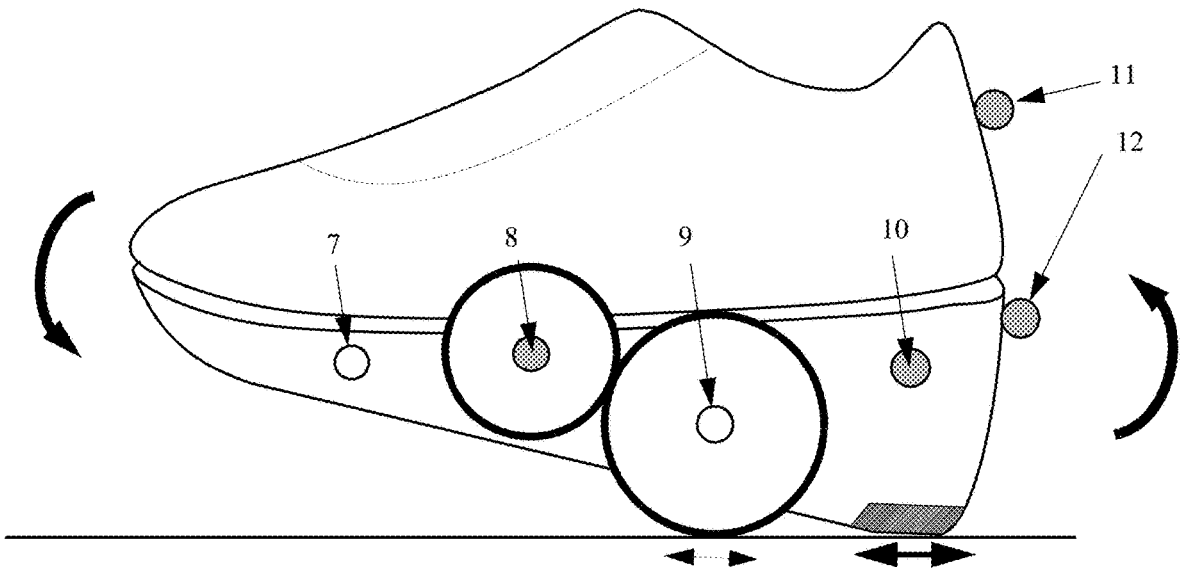

FIG. 9 illustrates the second function of exemplary embodiment III of the invention for short-distance walking without removing all the wheels. As illustrated, the forefoot-portion wheel can be removed from the axle location 7 and stowed at location 8 so as to contact the arch-portion wheel at axle location 9. Under the circumstance, rotation of both wheels are mutually constrained, the user can thus walk with reduced likelihood of inadvertent rolling.

For short-distance walking without removing all the wheels, there are at least, but not limited to, two additional methods as listed below:

1. Let the forefoot-portion wheel stay at axle location 7, and move the arch-portion wheel from axle location 9 to location 8 so as to contact the forefoot-portion wheel for mutual constraint of rotation.
2. Let the arch-portion wheel stay at axle location 9, and move the forefoot-portion wheel from axle location 7 to location 10 so as to contact the arch-portion wheel for mutual constraint of rotation.

Note that, in order to employ the above methods interchangeably, the distance between locations 7 and 8, the distance between locations 8 and 9, as well as the distance between locations 9 and 10 need to be practically the same.

Figure 10:
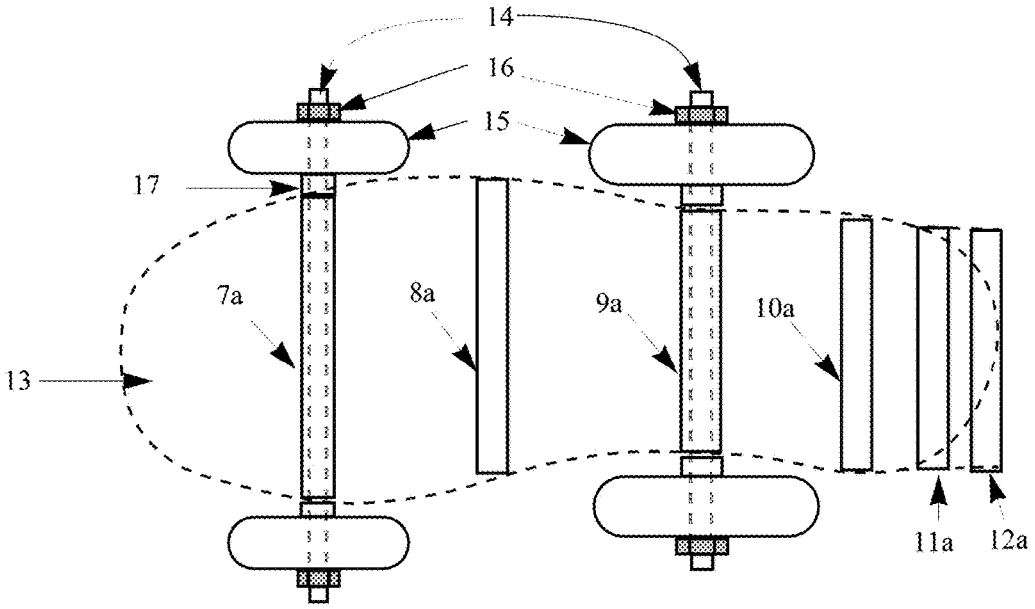

FIG. 10 illustrates one of the conventional methods using nuts and threaded rods for configuring wheels to various locations of the device. As shown, the footwear 13 contains multiple hollow tubes 7*a*, 8*a*, 9*a*, 10*a*, 11*a*, and 12*a* that are inserted into the sole/heel at locations 7, 8, 9, and 10 or attached to the counter at locations 11 and 12 for housing the threaded rods 14. The wheels 15 are mounted on the rods 14 and are held in place by the nuts 16. Depending on the exterior curvature of the footwear 13, spacers 17 (optional) may be used to prevent wheels 15 from rubbing against various parts of the footwear 13.

For clarification: The present patent application does NOT claim any of the conventional wheel-configuring methods, but DOES claim the design of wheel-stowage locations including, but not limited to, locations 8, 10, 11, and 12 in the sole, heel, and counter for reducing the likelihood of inadvertent rolling on the ground surface, as illustrated in FIGS. 8 and 9.

Aside from using nuts 16, there are other methods for securing wheels 15 to a footwear device, such as replacing each nut 16 with a pin inserted into a machined hole near the end of the rod 14, which prevents a wheel 15 from sliding out.

Figure 11A:
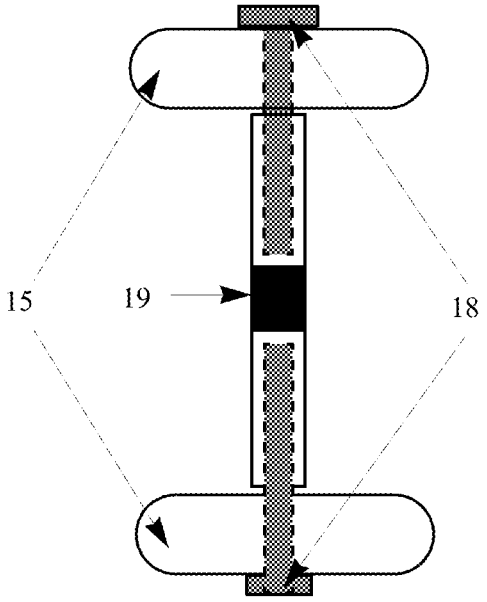
FIGS. 11A and 11B illustrate methods of securing two wheels by using two capped rods that are attracted to a magnet. The magnet can be configured in the housing tube or at the uncapped end of one of the rods. Both methods have the advantage of easy removability.

In addition, FIG. 11A illustrates a method of securing the two wheels 15 by using two capped rods 18 that are attracted to a magnet 19 configured in the housing tube.

Figure 11B:
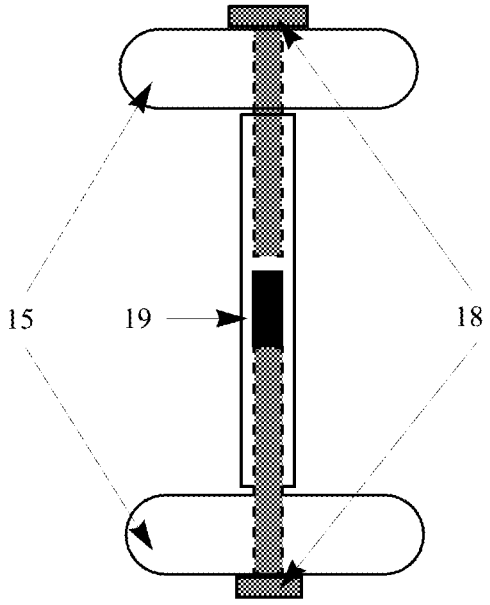

FIG. 11B illustrates a similar method of securing the two wheels 15 by using two capped rods 18 that are attracted to a magnet 19 that is configured at the uncapped end of one of the rods. The obvious advantage of using the magnet is to have easy removability.

Figure 12:
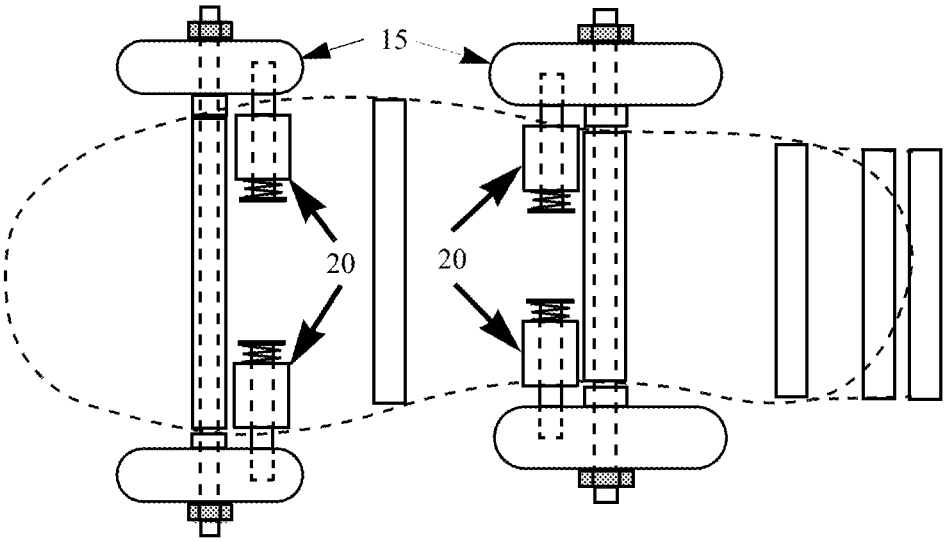

FIG. 12 illustrates exemplary embodiment IV of the invention, wherein latching mechanisms 20 are configured to prevent the wheels from inadvertent rolling during standing or walking. In one configuration, a latching mechanism can comprise a bolt being inserted between the spokes of the wheel 15 so as to block the rolling. In another configuration, the latching mechanism can comprise a bolt with a frictional tip/pad pushing against the rim or tire of the wheel 15 so as to hinder the rolling. In general, the latching mechanisms 20 can be activated by manual and/or mechanical means. It can also use push-pull solenoids that are activated remotely by electronic means.

Figure 13:
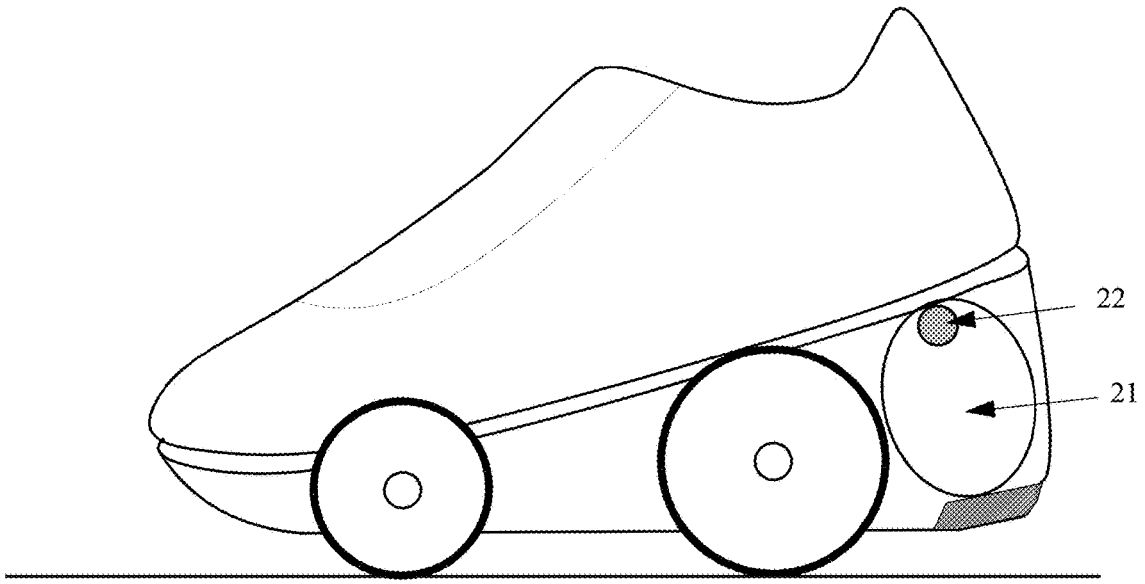

FIG. 13 illustrates exemplary embodiment V of the invention, wherein a part of the sole and/or heel is removed for reducing the footwear weight. The cavity and/or cutout 21 is internally lined with lightweight/strong materials including, but not limited to, polymers and composite materials for supporting the user's weight. In addition, a stowage location 22 may be configured inside the cavity 21.

Figure 14:
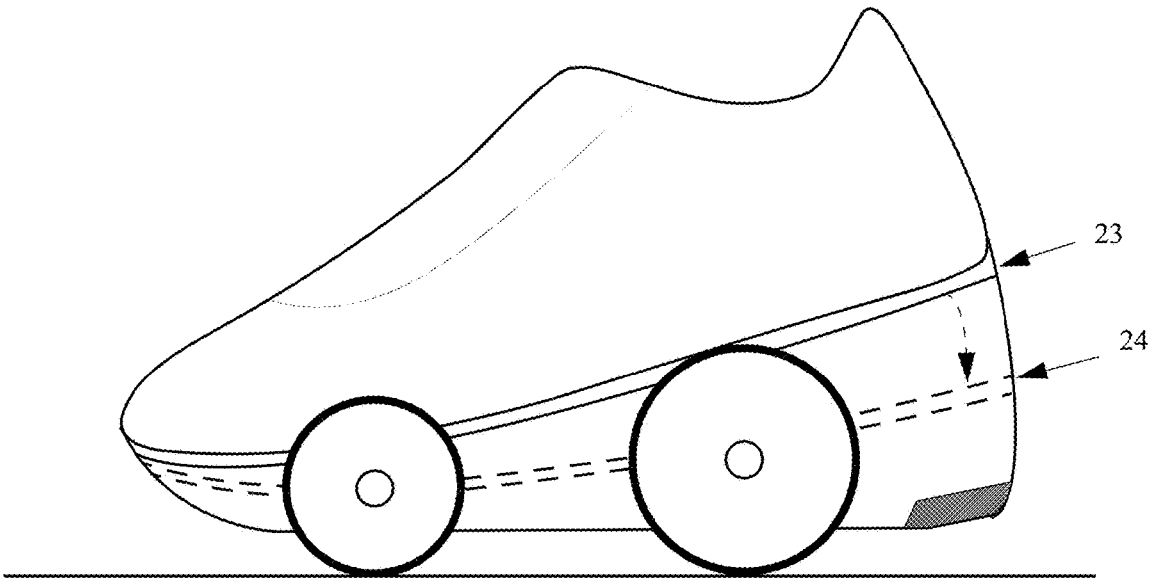

FIG. 14 illustrates exemplary embodiment VI of the invention, wherein the device is configured in such a manner that its exterior shows a sole and heel with thickness similar to that of regular footwear. Specifically, the exterior boundary 23 normally demarcating the top of the footwear sole is lowered to location 24 in order to project the superficial appearance of regular footwear, for aesthetic purposes.

Figure 15:
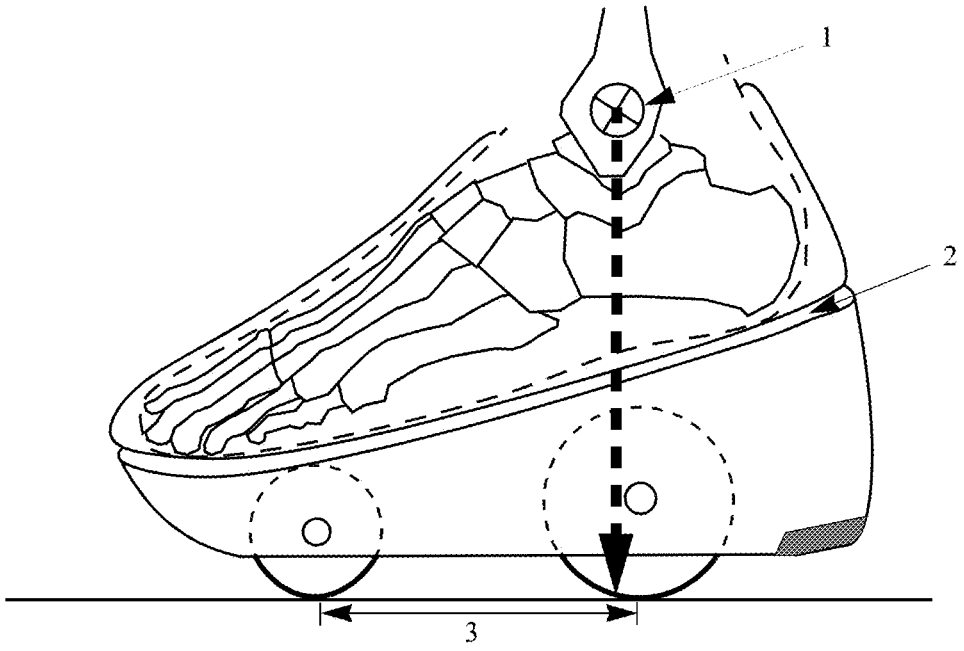

For aesthetic and other requirements, it may be desirable to reduce the exposure/visibility of the wheels. FIG. 15 illustrates the first function of exemplary embodiment VII for sustained rolling with wheels configured inside the sole. To achieve the design, 1. Wheels of small size may be used, although not necessary.
2. The number of wheels per axle may be changed, although not necessary.

As illustrated in FIG. 15, the configuration of the device enables the top side of the footwear sole 2 to function as a sloped supporting surface that allows the user's forefoot to tilt down and project the ankle load 1 onto the front span 3 between the forefoot-portion wheels and the arch-portion wheels, which enables stable and sustained rolling.

Figure 16:
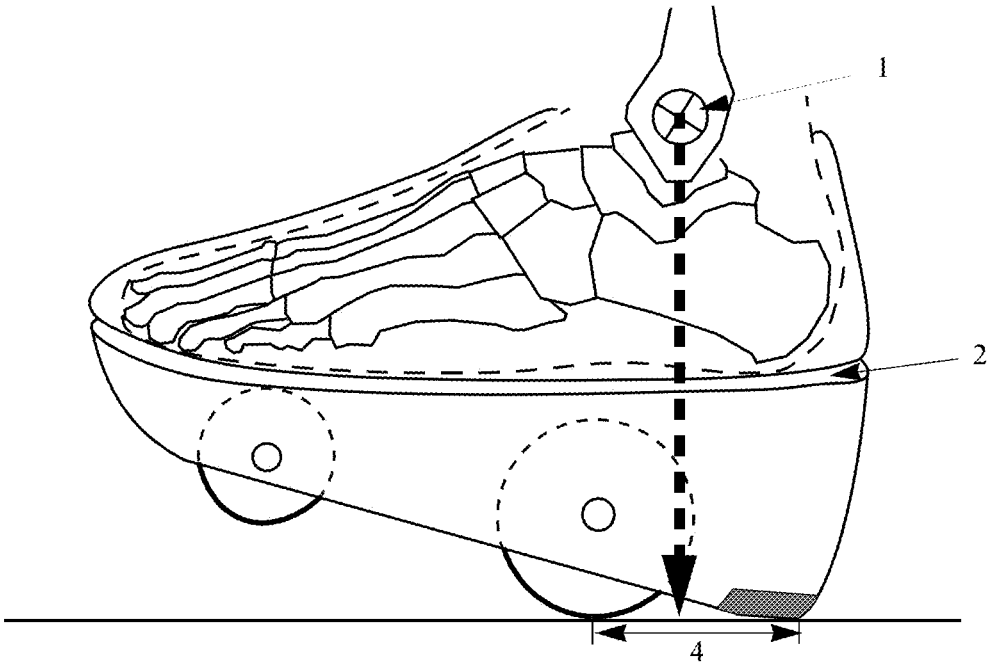

FIG. 16 illustrates the second function of exemplary embodiment VII for stable braking, secure standing, and brief period of stepping. As the user shifts the weight aft, the footwear device rotates about the arch-portion wheels. Consequently, the supporting surface 2 becomes more level and allows the user to project the ankle load 1 onto the rear span 4 between the arch-portion wheels and heel-tip, which enables braking, standing, and stepping.

Figure 17:
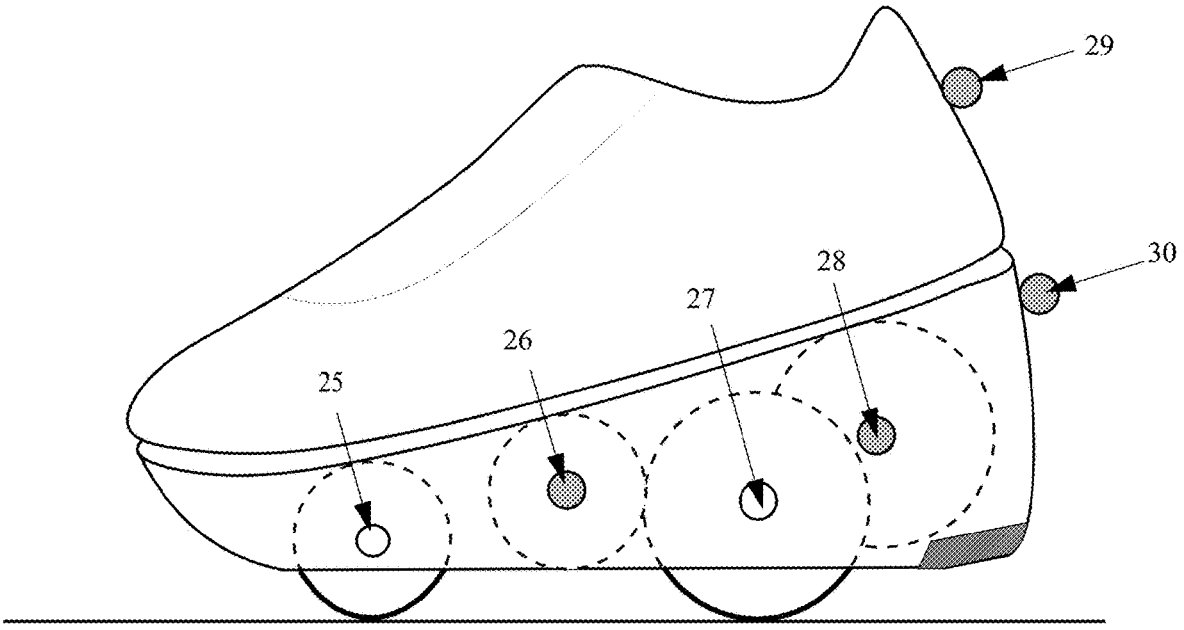

FIG. 17 illustrates exemplary embodiment VIII that comprises two rolling axle locations (25 and 27) as well as multiple stowage locations 26, 28, 29 and 30 for the wheels, which enables two additional functions:

1. Short-distance walking, wherein the forefoot-portion wheel can be moved from the axle location 25 to the stowage location 26 so as to contact the arch-portion wheel at location 27. Under the circumstance, rotation of both wheels are mutually constrained, the user can thus walk with reduced likelihood of inadvertent rolling.
2. Long-distance walking, wherein all wheels can be removed from axle locations (25, 27) and stowed in different locations such as 26, 28, 29 and 30 of the footwear so as to avoid contacting the ground. The device can thus function like regular shoes.

FIGS. 18A through 18D illustrate the bottom view of exemplary embodiment VIII that comprise cutouts and modification to the sole for moving wheels from axle locations (25, 27) to stowage locations (26, 28) so as to enable the short-distance and long-distance walking functions.

Figure 18A:
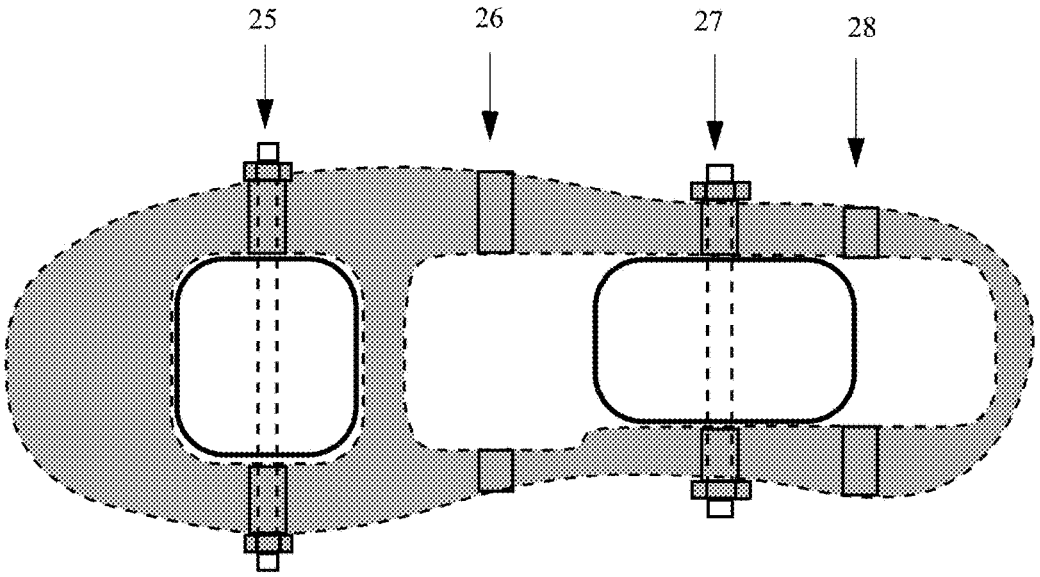
FIGS. 18A through 18D illustrate the bottom view of exemplary embodiment VIII that comprise cutouts and modifications to the sole for moving wheels from axle locations to stowage locations so as to enable the short-distance and long-distance walking functions.

FIG. 18A is exemplary embodiment VIII configured with 1 forefoot-portion wheel and 1 arch-portion wheel.

Figure 18B:
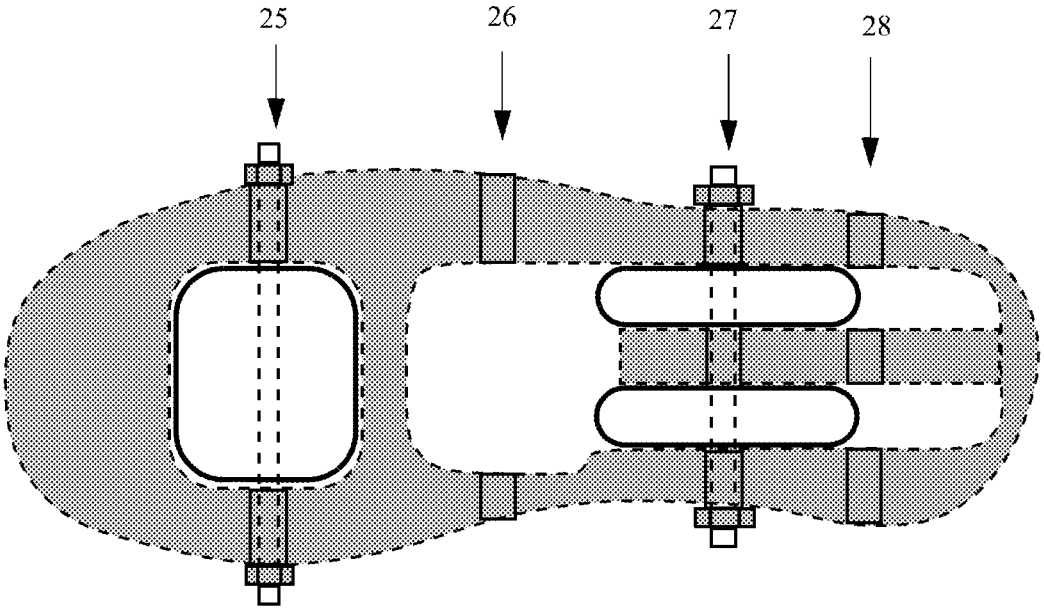

FIG. 18B is exemplary embodiment VIII configured with 1 forefoot-portion wheel and 2 arch-portion wheels.

Figure 18C:
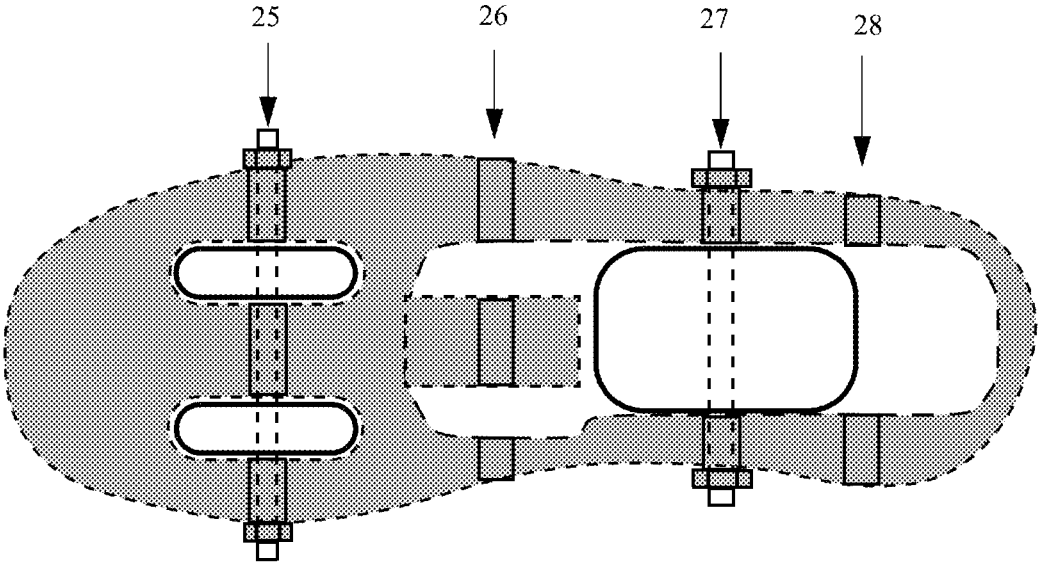

FIG. 18C is exemplary embodiment VIII configured with 2 forefoot-portion wheels and 1 arch-portion wheel.

Figure 18D:
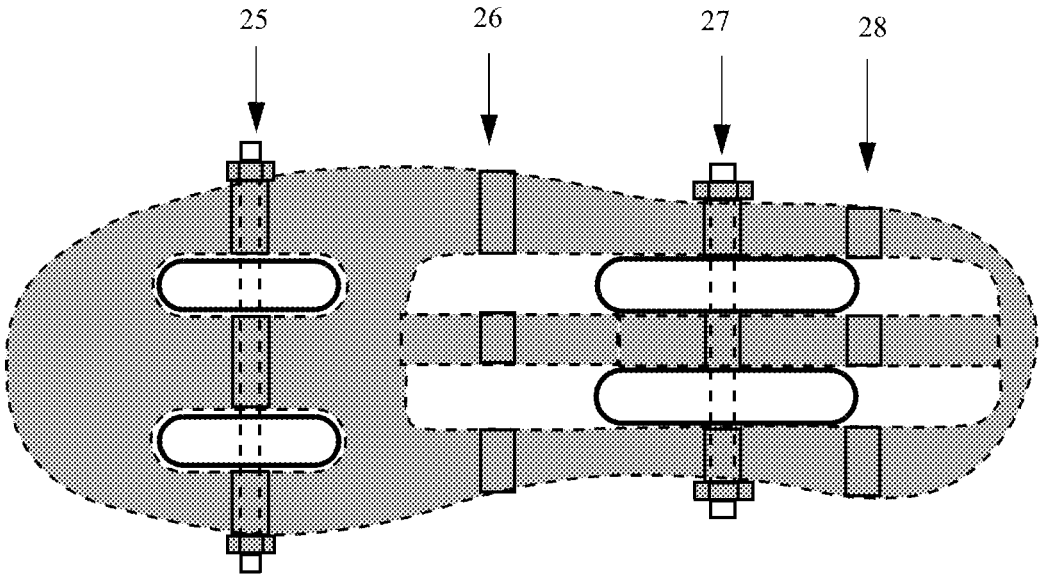

FIG. 18D is exemplary embodiment VIII configured with 2 forefoot-portion wheels and 2 arch-portion wheels.

For clarification, the present patent application does NOT claim any of the conventional wheel-configuring methods, but does claim the design of wheel-stowage locations in the sole, heel, and counter for stowing wheels so as to reduce the likelihood of inadvertent rolling on the ground surface, as illustrated in FIG. 17 and the cavity/cutout areas shown in FIGS. 18A through 18D.

Figure 19:
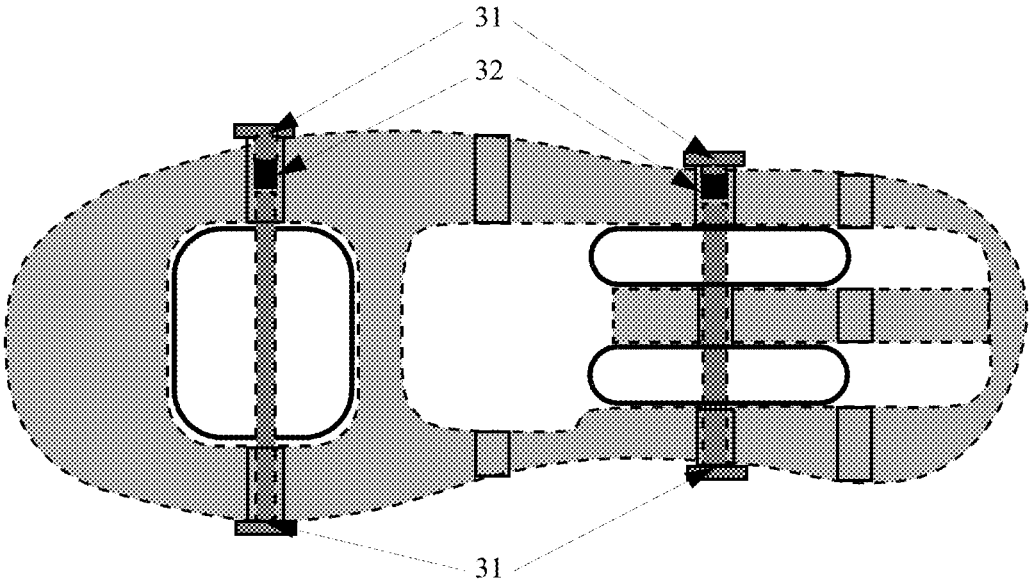

Aside from using nuts and threaded rods, there are other methods for securing wheels that are configured inside the sole of a footwear device. FIG. 19 illustrates a method of securing one wheel or two wheels by using two capped rods 31 that are attracted to a magnet 32 that is configured at the uncapped end of one of the rods. The obvious advantage of using the magnet is to have easy removability.

Figure 20:
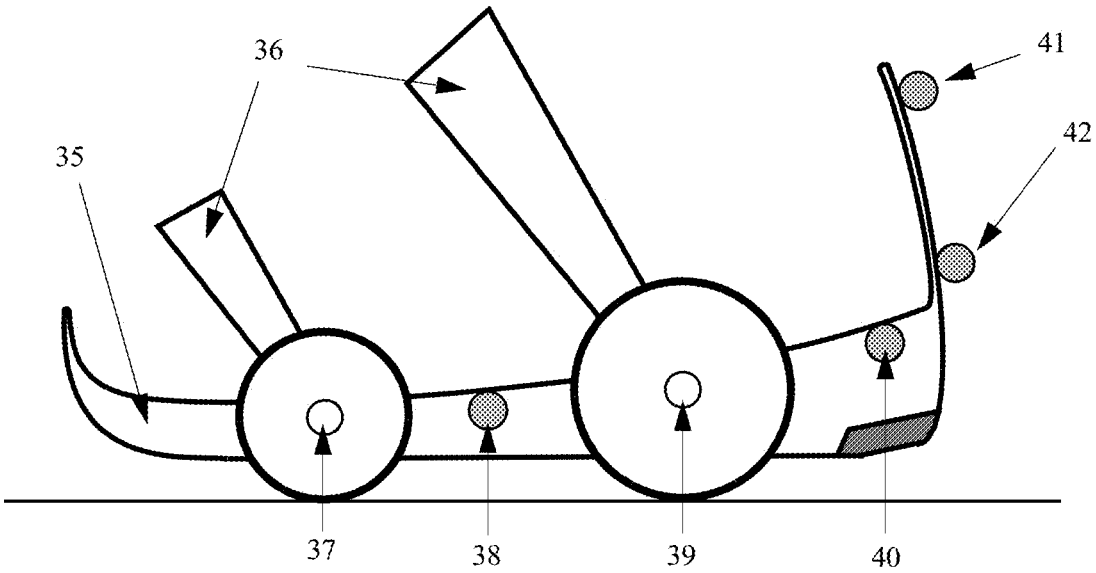
FIGS. 20 through 24 illustrate the exemplary embodiments pertaining to a wheeled footwear platform.
4.

FIG. 20 illustrates exemplary embodiment IX of the invention pertaining to a wheeled footwear platform 35 with two straps 36 for fastening regular footwear. The platform 35 is configured with a plurality of axle locations (37, 39) as well as stowage locations 38, 40, 41, and 42 for wheels.

Figure 21:
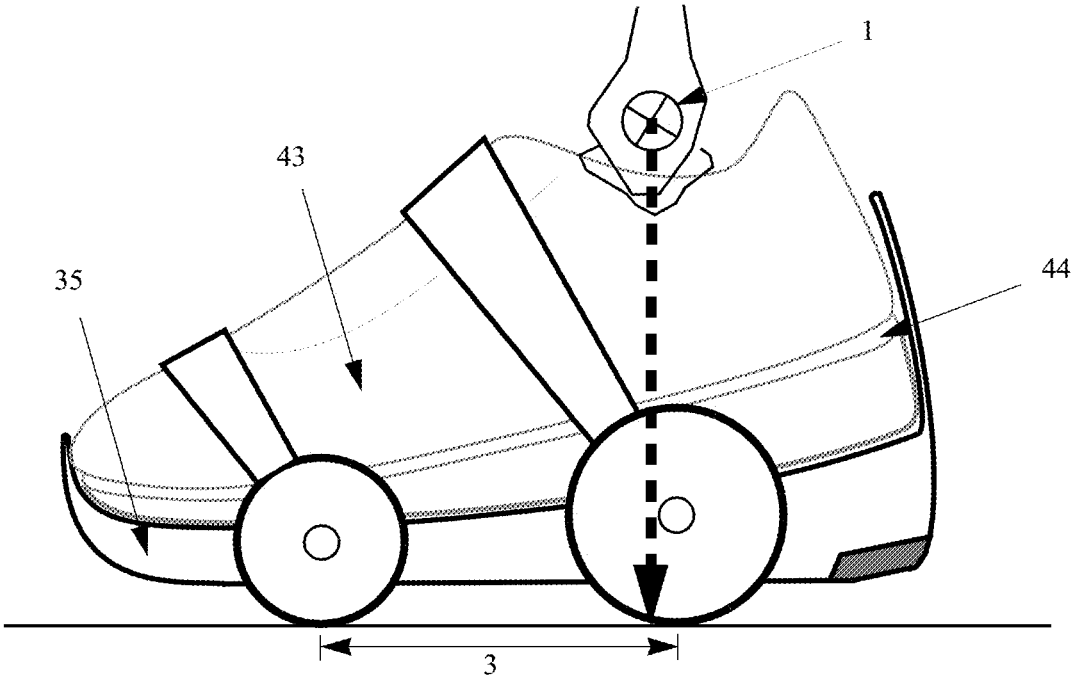

FIG. 21 illustrates the first function of exemplary embodiment IX for sustained rolling. As the platform 35 is attached to regular footwear 43 (depicted by dotted lines), the top side of the footwear sole 44 forms a sloped supporting surface similar to the supporting surface 2 in FIG. 3, which allows the user's forefoot to tilt down and project the ankle load 1 onto the front span 3 between the forefoot-portion wheels and the arch-portion wheels, so as to enables a stable and sustained rolling.

Figure 22:
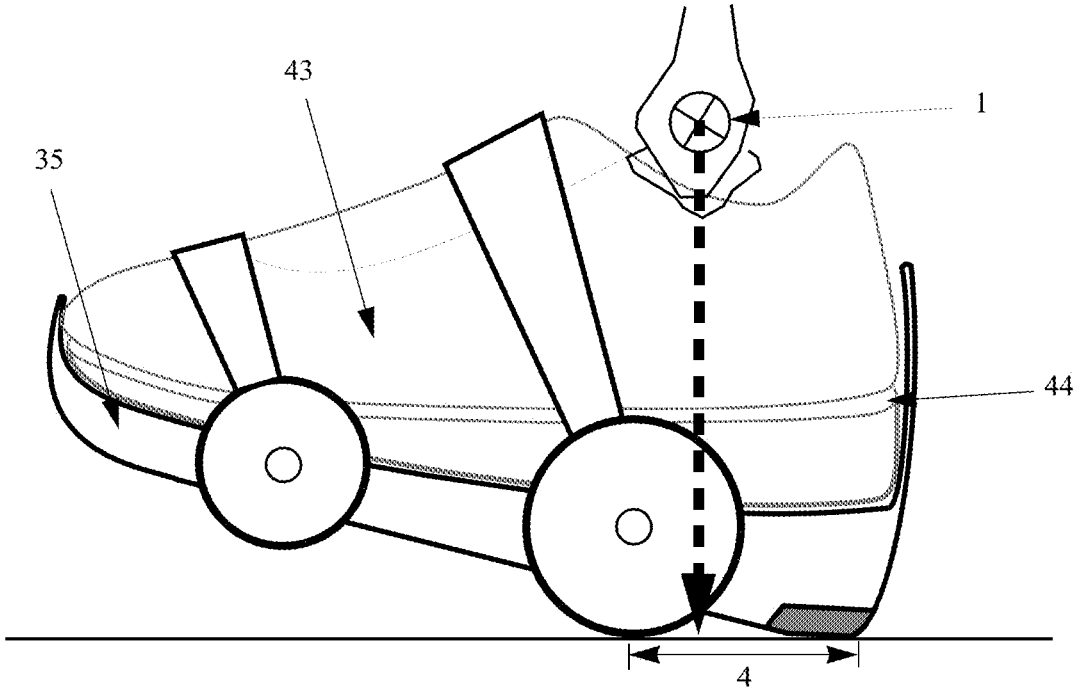
Figure 23:
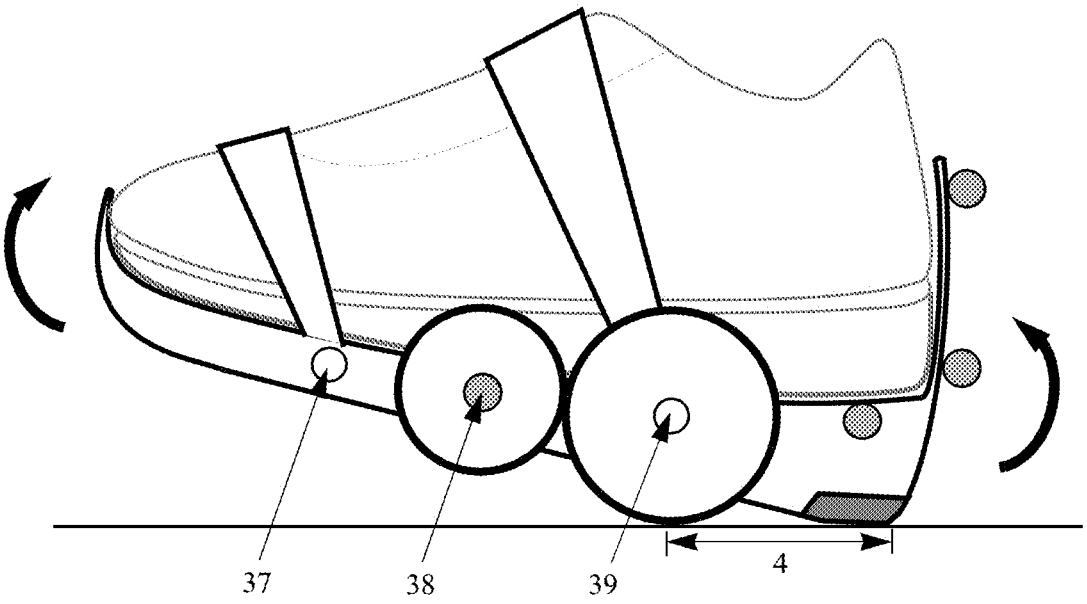

FIG. 22 illustrates the second function of exemplary embodiment IX for stable braking, secure standing, and brief period of stepping. As the user shifts the weight aft, the wheeled footwear platform rotates about the arch-portion wheels and the top side of the footwear sole 44 becomes more level (similar to the supporting surface 2 in FIG. 4), which allows the user to project the ankle load 1 onto the rear span 4 between the arch-portion wheels and the heel-tip, so as to enable braking, standing, and stepping FIG. 23 illustrates exemplary embodiment X of the invention for short-distance walking without removing all the wheels. As illustrated, the forefoot-portion wheel can be removed from the axle location 37 and stowed at location 38 so as to contact the arch-portion wheel at axle location 39. Under the circumstance, rotation of both wheels are mutually constrained, the user can thus walk with reduced likelihood of inadvertent rolling.

The wheeled footwear platform can also be configured with stopper elements, heel-extension elements, additional stowage locations, latching mechanisms, and cavity/cutout in ways similar to the wheeled footwear device as shown in FIGS. 5 through 13, so as to achieve the same functionality of exemplary embodiments II, III, IV, and V.

Figure 24:
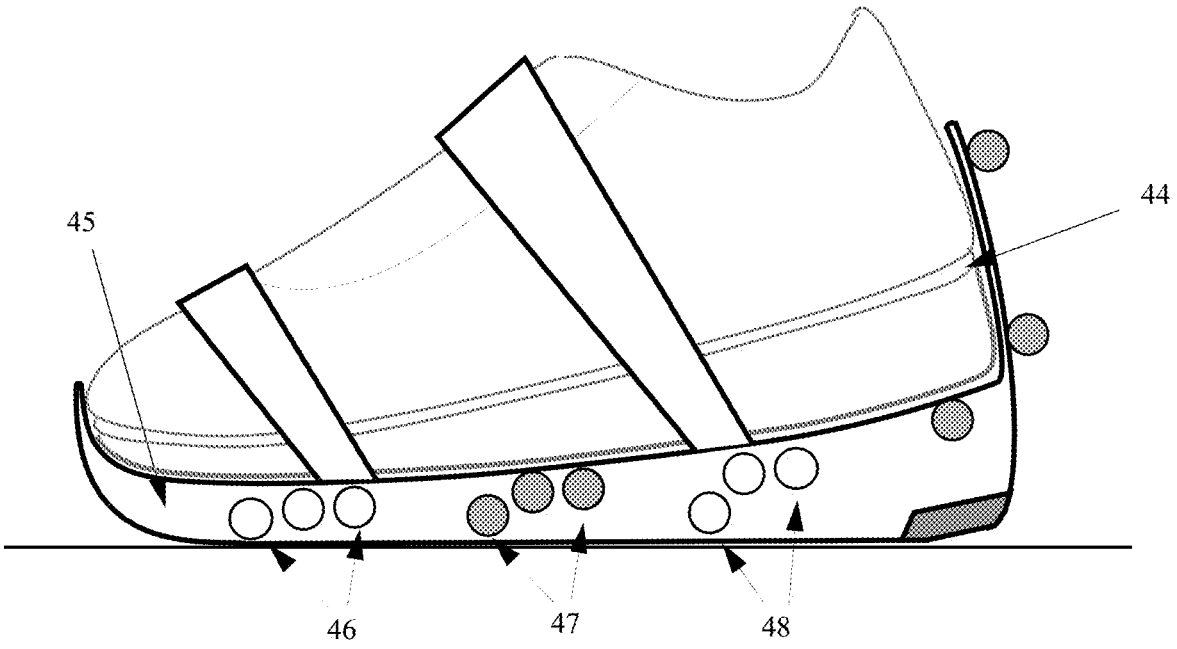

FIG. 24 illustrates exemplary embodiment XI of the invention, pertaining to an adjustable wheeled footwear platform 45 that can accommodate footwear soles of various thickness and slope. As illustrated, multiple axle locations 46 are configured for forefoot-portion wheels, and multiple axle locations 48 are configured for arch-portion wheels. Depending on the thickness and slope of the footwear sole, a user can select different axle locations for the wheels, such that the top side of the footwear sole 44 forms a sloped supporting surface similar to the supporting surface 2 in FIGS. 3 and 4. Therefore a user can conduct sustained rolling, braking, and secure standing by shifting the weight forward and aft.

In addition, multiple stowage locations 47 can be configured such that the stowed forefoot-portion wheel can contact the arch-portion wheel at multiple axle locations 48 so as to enable short-distance walking, as illustrated in FIG. 23.

For the wheeled footwear platform, it may be desirable to configure the wheels inside the sole for aesthetic and other requirements. FIG. 25 illustrates the first function of exemplary embodiment XII pertaining to a wheeled footwear platform 49 with wheels configured inside the sole. To achieve the design, 1. Wheels of small size may be used, although not necessary.
2. The number of wheels per axle may vary, similar to what have been illustrated in FIGS. 18A through 18D.

As illustrated in FIG. 25, the configuration of the device enables the top side of the footwear sole 44 to function as a sloped supporting surface that allows the user's forefoot to tilt down and project the ankle load 1 onto the front span 3 between the forefoot-portion wheels and the arch-portion wheels, which enables stable and sustained rolling.

FIG. 26 illustrates the second function of exemplary embodiment XII for stable braking, secure standing, and brief period of stepping. As the user shifts the weight aft, the wheeled footwear platform rotates about the arch-portion wheels and the top side of the footwear sole 44 becomes more level, which allows the user to project the ankle load 1 onto the rear span 4 between the arch-portion wheels and heel-tip, so as to enable braking, standing, and stepping.

FIG. 27 illustrates exemplary embodiment XIII that comprises two rolling axle locations (50, 52) as well as multiple stowage locations 51, 53, 54 and 55 for the wheels, which enables two additional functions:

1. Short-distance walking, wherein the forefoot-portion wheel can be moved from the axle location 50 to the stowage location 51 so as to contact the arch-portion wheel at location 52. Under the circumstance, rotation of both wheels are mutually constrained, the user can thus walk with reduced likelihood of inadvertent rolling.
2. Long-distance walking, wherein all wheels can be removed from axle locations (50, 52) and stowed in different locations such as 51, 53, 54 and 55 of the platform so as to avoid contacting the ground. The device can thus function like regular shoes.

At this point, it is apparent that the cutouts and modification to the sole of exemplary embodiment VIII, as previously illustrated in FIGS. 18A through 18D, can all be applied to the sole of exemplary embodiment XIII so as to accommodate varying numbers of wheels per axle and to enable the short-distance and long-distance walking functions.

FIGS. 28 and 29 illustrate exemplary embodiment XIV of the invention in the form of a wheeled artificial foot 56 that can be attached to, but not limited to, a controlling prosthetic or robotic limb.

FIG. 28 elaborates on the first function of exemplary embodiment XIV for sustained rolling. As the controlling limb shifts the ankle load 1 forward and projects it onto the front span 3 between the forefoot-portion wheel(s) and the arch-portion wheel(s), a sustained rolling is enabled.

FIG. 29 illustrates the second function of exemplary embodiment XIV for stable braking secure standing, and brief period of stepping. As the controlling limb shifts the ankle load 1 aft and projects it onto the rear span 4 between the arch-portion wheel(s) and heel-tip, braking, standing, and/or stepping can be enabled.

The wheeled artificial foot can also be configured with stopper elements, heel-extension elements, stowage locations, latching mechanisms, and cavity/cutout in ways similar to those of the wheeled footwear device as shown in FIGS. 5 through 13, so as to achieve the same functionality of exemplary embodiments II, III, IV, and V.

For a wheeled footwear device that is configured conventionally with wheels in the forefoot-portion and heel-portion of the sole, the present patent application claims the design of stowage locations for wheels not used in rolling. FIG. 30 illustrates exemplary embodiment XV of the invention pertaining to a conventional wheeled footwear device, wherein wheels can be removed from the rolling axle locations 57 and 58, and stowed onto locations 57*a*, 58*a*, 59 and 60.

The conventional wheeled footwear device can also be configured with stowage locations and latching mechanisms in ways similar to those of the wheeled footwear device as shown in FIGS. 8 through 12, so as to achieve the same functionality of exemplary embodiments III and IV.

Having thus described the invention with particular reference to preferred embodiments, it will be obvious to those having ordinary skill in the art to which the invention pertains numerous variations and changes that can be made without departing from the spirit and scope of the inventions as defined in the appended claims.

The invention claimed is:

1. A wheeled device for securing and supporting the foot load of the user; wherein the device sole comprises a forefoot portion wherein at least one wheel is configured;

a heel portion with a lower, heel-tip part geometrically configured for contacting a surface;

an arch portion wherein at least one wheel is configured in a protruding manner that prevents the forefoot portion and the heel portion from contacting the surface simultaneously, so as to form two spans of different slopes: one before and one after the arch-portion wheel;

wherein a user can conduct and sustain rolling by shifting one's weight forward so as to project one's ankle load onto the span between the forefoot-portion wheel and the arch-portion wheel; and wherein a user can conduct braking and standing by shifting one's weight aft so as to project one's ankle load onto the span between the arch-portion wheel and the heel-tip.

2. A wheeled device as described in claim 1, wherein the forefoot-portion sole is configured with one wheel along the sole's centerline, and the arch-portion sole is configured with one wheel along the sole's centerline.

3. A wheeled device as described in claim 1, wherein the forefoot-portion sole is configured with one wheel along the sole's centerline, and the arch-portion sole is configured with one wheel on each side of the sole's centerline.

4. A wheeled device as described in claim 1, wherein the forefoot-portion sole is configured with one wheel on each side of the sole's centerline, and the arch-portion sole is configured with one wheel along the sole's centerline.

5. A wheeled device as described in claim 1, wherein the forefoot-portion sole is configured with one wheel on each side of the sole's centerline, and the arch-portion sole is configured with one wheel on each side of the sole's centerline.

6. A wheeled device as described in claim 1, wherein the heel-tip is configured with at least a stopper element for braking on the surface.

7. A wheeled device as described in claim 1, wherein at least one stowage is configured for storing a wheel that is not used for rolling.

8. A wheeled device as described in claim 7, wherein the rolling motion of at least one wheel is hindered due to contact with a stowed wheel or the associated stowage elements.

9. A wheeled device as described in claim 7, wherein all wheels are stowed from contacting the ground surface, thus the device can function like a regular shoe for standing and walking.

10. A wheeled device as described in claim 1, wherein at least one tube is configured for housing an axle of the wheel, wherein the axle comprises at least two capped rods that are attracted to and held in place by magnetic force.

11. A wheeled device as described in claim 10, wherein at least one rod is a permanent magnet.

12. A wheeled device as described in claim 10, wherein at least one permanent magnet is configured inside the tube.

13. A wheeled device as described in claim 10, wherein at least one magnet is configured at the uncapped end of a rod.

14. A wheeled device as described in claim 1, wherein the heel-portion sole is configured with at least one extension element for supporting the load applied by the other device worn by the user, so as to increase the friction on the heel-tip for braking and standing.

15. A wheeled device as described in claim 1, wherein at least one latch mechanism is configured to lock the wheel from rolling, wherein the latch may be activated by manual means.

16. A wheeled device as described in claim 1, wherein at least one latch mechanism is configured to lock the wheel from rolling, wherein the latch may be activated by electrical means.

17. A wheeled device as described in claim 1, wherein at least a part of the sole is replaced with a cutout that is lined internally with reinforcing material.

18. A wheeled device as described in claim 17, wherein at least one stowage is configured in a cutout for storing the wheel that is not used for rolling.

19. A wheeled device as described in claim 1, wherein the external boundary normally demarcating the top of the sole is adjusted to project a superficial appearance of a sole of regular footwear.

* * * * *